United States Patent [19]

Neuroth

[11] Patent Number: 4,532,374

[45] Date of Patent: Jul. 30, 1985

[54] ELECTRICAL CABLE FOR USE IN EXTREME ENVIRONMENTS

[75] Inventor: David H. Neuroth, Bethany, Conn.

[73] Assignee: Harvey Hubbell Incorporated, Orange, Conn.

[21] Appl. No.: 599,650

[22] Filed: Apr. 12, 1984

Related U.S. Application Data

[63] Continuation-in-part of Ser. No. 447,969, Dec. 8, 1982.

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F, 47

[56] References Cited

U.S. PATENT DOCUMENTS

| | | | |
|---|---|---|---|
| 1,740,076 | 12/1929 | Delon | 174/116 X |
| 1,927,845 | 9/1933 | Pheazey | 173/266 |
| 2,165,738 | 7/1939 | Van Hoffen | 174/105 R |
| 2,391,037 | 12/1945 | Shafer, Jr. | 174/102 SP |
| 2,483,301 | 9/1949 | Roberds | 174/15 C |
| 2,544,233 | 3/1951 | Kennedy | 174/117 R X |
| 2,897,253 | 7/1959 | Davey et al. | 174/109 X |
| 3,351,706 | 11/1967 | Gnette et al. | 174/105 R |
| 3,404,217 | 10/1968 | Kelly | 174/103 |
| 4,196,307 | 4/1980 | Moore et al. | 174/47 |
| 4,262,703 | 4/1981 | Moore et al. | 174/47 X |
| 4,277,642 | 7/1981 | Piper et al. | 174/117 R X |
| 4,282,398 | 8/1981 | Solomon | 174/106 R |
| 4,374,530 | 2/1983 | Walling | 174/47 X |
| 4,409,431 | 10/1983 | Neuroth | 174/103 |
| 4,453,035 | 6/1984 | Neuroth | 174/103 |
| 4,453,036 | 6/1984 | Neuroth | 174/103 |
| 4,454,377 | 6/1984 | Neuroth | 174/103 |
| 4,454,378 | 6/1984 | Neuroth | 174/103 |

FOREIGN PATENT DOCUMENTS

| | | | |
|---|---|---|---|
| 0060061 | 9/1982 | European Pat. Off. . | |
| 1020074 | 11/1957 | Fed. Rep. of Germany | 174/117 R |
| 437525 | 10/1935 | United Kingdom . | |
| 699558 | 11/1953 | United Kingdom . | |
| 1242494 | 8/1971 | United Kingdom . | |
| 1250823 | 10/1971 | United Kingdom | 174/136 |
| 1418554 | 12/1975 | United Kingdom . | |
| 2069746 | 8/1981 | United Kingdom . | |

*Primary Examiner*—A. T. Grimley
*Assistant Examiner*—Morris H. Nimmo
*Attorney, Agent, or Firm*—Jerry M. Presson; Alfred N. Goodman

[57] ABSTRACT

An armored cable having a plurality of individually insulated conductors and force-resisting members formed with an arcuate cross-sectional shape which substantially conforms to the curvature of the surface on which it is mounted. Opposite surfaces of each force-resisting member in the cable have different widths in cross-section to provide the desired enclosure of the underlying insulation on a conductor after the formation of the arcuate bend in the cable.

14 Claims, 7 Drawing Figures

ELECTRICAL CABLE FOR USE IN EXTREME ENVIRONMENTS

This application is a continuation-in-part of my copending U.S. patent application Ser. No. 447,969 filed Dec. 8, 1982 issued as U.S. Pat. No. 4,454,378 on June 12, 1984 and assigned to the same assignee as the instant invention.

This invention relates to a flattened cable for use in extreme environments and more particularly, to a cable of arcuate, cross-sectional shape for supplying electrical power to submersible oil well pumps.

BACKGROUND OF THE INVENTION

Electrical cables which are used for supplying electrical energy to submersible oil well pumps are typically of flattened, cross-sectional shape and must be able to survive and perform satisfactorily under extremely adverse conditions of mechanical stress.

Such cables are subjected to mechanical stresses in several ways. It is common practice to fixedly attach the cables to the housing of the electrical submersible pump or oil well tubing by means of bands or straps which may crush the cables and thereby seriously degrade the quality of the insulation and the electrical integrity of the cable. The cables are also subject to impact damage during installation and high compression loads during and after installation. To resist these forces, it is conventional to apply an outer metal armor to the cable and to enclose the individual conductors with layers of materials chosen to enhance their strength characteristics. Such measures are sometimes not adequate to provide the necessary insulation protection, especially against edge impacts and edge abrasion.

An additional problem arises as a result of down-hole pressures, which can be in the hundreds or thousands of pounds per square inch, to which the cables are subjected. Typically, the insulation surrounding the conductors in a cable contains micropores into which gas is forced at these high pressures over a period of time. Then, when the cable is rather quickly extracted from the well, or the pressures applied to the cable by the column of fluid in the well bore change dramatically due to intermittent operation of the pump powered by the cable, there is insufficient time for the intrapore pressure to bleed off. As a result of repeated decompressions, the insulation tends to expand and contract and can rupture rendering the cable weakened or useless.

In U.S. Pat. No. 4,409,431, assigned to the same assignee as the instant invention, there is described a cable structure which is particularly suitable for use in such extremely adverse environments. The structure protects the cable against inwardly-directed compressive forces and provides for the dissipation of heat from the cable interior to the surrounding environment which is an important feature in high temperature operating environments, for reasons discussed therein, as well as resistance to decompression expansion of the insulation.

As described in said U.S. Pat. No. 4,409,431, the cable protective structure includes one or more elongated, force-resisting members which extend parallel and adjacent an insulated conductor of the cable. The members are rigid in cross-section to resist compressive forces which would otherwise be borne by the cable conductors. For applications requiring the cable to undergo long-radius bends in service, the elongated support may be formed with a row of spaced-apart slots which extend perpendicularly from the one edge of the member into its body to reduce the cross-sectional rigidity of the member in the slotted areas so as to provide flexibility in the support to large-radius bending about its longitudinal axis.

As described in my copending patent application Ser. No. 390,308 filed June 21, 1982 issued as U.S. Pat. No. 4,454,377 on June 12, 1984 and assigned to the same assignee as the present invention, for certain service applications, it may be preferred that the electrical insulating sheath on the cable conductor not be in direct contact with the slot openings. This is because the slot openings in the support member may allow highly corrosive materials to gain access to the jacket composition by flowing inwardly through the slots. In addition, the sharp corner edges formed by slotting may cut into or abrade the underlying cable jacket upon repeated flexing of the cable.

The cable protective structure of said copending application Ser. No. 390,308 is made of a composite structure which utilizes an elongated force-resisting member of good thermal conductivity positioned adjacent the insulating conductor sheath. This member comprises a channel member of U-cross-sectional shape. A smooth, bendable liner may be mounted within the channel facing the insulation of the adjacent conductor to bridge the slots in the member and thereby protect the underlying insulation from abrasion by the slot edges during bending of the channel member.

The exterior jacket or armor, the liners and the channel members all serve to protect the conductor insulation, and hence the cable, from damage caused by compression forces, impacts and decompression expansion.

Supplementary resistance to compressive forces may be obtained with a cable constructed in accordance with my copending applications Ser. Nos. 429,530 and 429,781, filed on Sept. 30, 1982 issued as U.S. Pat. Nos. 4,453,035 and 4,453,036, respectively, on June 5, 1984, and assigned to the same assignee as the instant invention.

For certain service applications and particularly oil well applications, the cable must be able to be axially inserted and withdrawn through an open space formed between the interior circular wall of the well casing and the exterior surface of the oil well tubing, electric submersible pump housing or other structure to which the cable is affixed. Typically, the cable is mounted on the exterior surface of a centrifugal pump and hence, extends outwardly of the pump housing thereby posing a potential obstruction to a proper fit in the oil well casing. Furthermore, it follows that the thicker the cable in cross-section, the smaller the cross-sectional dimension that the pump must have for both to fit into an oil casing of a given cross-sectional size. Electrically-powered centrifugal pumps, however, are typically much more efficient in large diameters, and thus, it is preferred that the cross-sectional thickness of the associated cable be made as small as possible so that the user can employ the most efficient pump. Since these structures are typically cylindrical, the open space between them is essentially annular in cross-section, being defined by two essentially circular surfaces of different radii.

As mentioned above, for these applications, the cable is subject to very high temperatures and pressures, severe compressive forces in the well and impacts during installation from, for example, hammers or other tools. Hence, it is desirable to use the cables disclosed in my aforementioned patent applications and yet, it is also desirable to minimize the effective thickness of the cable and thus, the possibility that the cable will jam or lodge against the well casing during the insertion or withdrawal of the equipment on which the cable is mounted.

As disclosed in my above-identified copending patent application Ser. No. 447,969, armored cable for oil well applications may have an arcuate cross-sectional shape which conforms to the curvature of the surface on which it is mounted. This reduces the effective thickness of the cable by conforming to and taking maximum advantage of the annular space available between the wall of the well casing and the outer cylindrical surface of the underlying pump housing or tubing. While this arcuate construction reduces the profile of the cable edges to abrasion and edge impacts under extreme usage conditions, the outside edges of the cable and hence, the insulation on the outside conductors may nonetheless receive destructive edge impacts as well as structural degradation resulting from abrading against the wall of the well casing.

My copending patent application Ser. No. 484,977 filed Apr. 14, 1983, issued as U.S. Pat. No. 4,490,577 on Dec. 25, 1984, and assigned to the same assignee as the instant invention, discloses an armored electrical cable structure of arcuate cross-sectional shape which is especially constructed to resist destruction and degradation of the conductor insulation on the outer conductors resulting from impacts and edge wear caused by abrasion. The structure also provides the additional benefits of resisting decompression expansion of the conductor insulation, attack by corrosive agents as well as the conduction of heat from the interior parts of the cable structure to the cable exterior for dissipation.

As described in said application Ser. No. 447,969, the arcuate cross-section results in manufacture of the cable by drawing the initially completely flat cable structure through coacting forming rollers which bend the armor and the interior components of the cable, including the conductors and the force-resisting members into an arcuate cross-section. As illustrated therein, the outer side portion of the cable has a greater radius of curvature and hence, a longer circumference in transverse cross-section, than the inner side portion. To compensate for this differential in transverse circumferential widths between the opposite arcuate side portions of the cable, the width of the upper surface 26 of the force-resisting member opposite and underlying the outer side portion of the jacket 11 is made wider than the lower surface 27 of the member opposite and overlying the inner side portion of the jacket 11 with its narrower circumferential width.

In accordance with this invention, an arcuate cable includes insulated conductors and force-resisting members adjacent thereto. The force-resisting members are of different widths in transverse cross-section with the greater width adjacent the circumferential longer side portion of the cable to provide the desired enclosure to the outermost insulation layer on each insulated conductor.

OBJECTS OF THE INVENTION

An object of this invention is to provide a substantially flat electrical cable having an arcuate shape in transverse cross-section which provides a complete protective enclosure to the insulation on the cable conductors.

Another object of this invention is to provide an armored electrical cable structure of arcuate cross-sectional shape for oil well applications incorporating a member for resisting various disruptive forces encountered in these applications, the force-resisting member being of different widths in transverse cross-section to provide the desired enclosure to the insulation on different ones of the cable conductors.

Other objects, advantages and salient features of the present invention will become apparent from the following detailed description which, taken in conjunction with the annexed drawings, discloses a preferred embodiment of the invention.

DETAILED DESCRIPTION OF THE INVENTION

Figure 1:
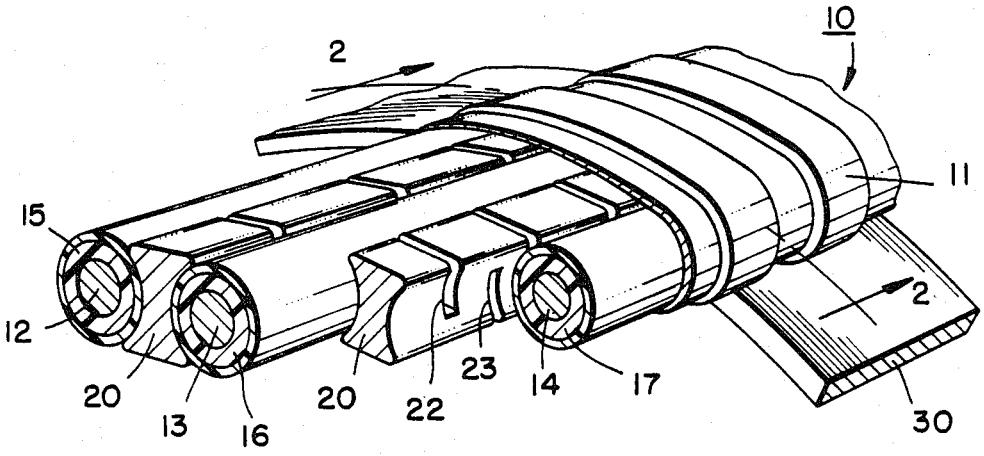
FIG. 1 is a partial perspective sectional view of a length of cable constructed in accordance with this invention and a portion of a housing or other structure of generally cylindrical shape to which the cable is typically affixed, the extremity of the cable being shown with an outer protective jacket removed.

FIG. 1 illustrates one embodiment of a cable 10 constructed in accordance with the present invention which is particularly suitable for use in oil well applications. For these applications, the cable must be able to be axially inserted and withdrawn through an open space formed between the interior circular wall of the well casing and the exterior surface of the oil well tubing, electric submersible pump housing or other structure to which the cable is affixed. Since these structures typically have arcuate surfaces and more particularly, cylindrical surfaces, the open space is essentially annular in cross-section because it is defined by two essentially concentric cylindrical surfaces of different diameters.

As mentioned above, for these applications the cable is subject to very high temperatures and pressures, and to very severe compressive forces in the well and impacts during installation from, for example, hammers or other tools.

The cable 10 includes a metal protective jacket 11 which surrounds and encloses a plurality of individually insulated, spaced-apart wires or conductors 12, 13 and 14. To provide the cable with a slightly arcuate cross-sectional configuration required for placement in the annular space between the well casing and the structure 30 to which the cable is strapped, the conductors are arranged so that their central axes lie in an arcuate plane parallel to the plane of the cylindrical surface of the structure 30 underlying the cable. In FIG. 1, only a portion of the structure 30 is depicted, it being understood that in its entirety the structure could be the outer housing of an oil well pump or the electrical motor for driving the pump, a cylindrical oil well tubing leading from the pump to the surface, or any other structure having a substantially cylindrical surface upon which the cable is to be mounted.

The jacket 11 is typically formed of steel tape 11 of a Z-cross-sectional shape which is wrapped about the conductors 12, 13 and 14 in overlapping helical fashion to form an interlocked armored sheath. The juxtaposed conductors are of considerable length, as needed, it being understood that only a very short length of the cable is illustrated in FIG. 1. The conductors 12, 13 and 14 are each covered by one or more layers of electrical insulation; two such layers being illustrated and referred to by the numerals 15, 16 and 17, respectively.

As will be recognized, the insulation used in these conductors is more than simply one or more layers of chemical barrier and/or electrically insulative material. Normally, in an environment such as an oil well, a pump cable would include insulation which is a system of layers of insulated materials of different types to provide the desired electrical dielectric properties as well as resistance to various chemical reactions which occur with accelerated activity in these high temperature and pressure environments, and these insulation materials may be constrained with, or otherwise mechanically protected by, braids and/or tapes composed of metal or other suitable material. However, this insulation and mechanical covering system is, in itself, not part of the present invention and is conventional and accordingly, it will not be further described herein.

The insulated conductors are each spaced laterally from one another far enough to provide a lateral space therebetween which will accommodate a force-resisting member 20. Each of the members 20 are also elongated and extend parallel with the conductors. Members 20 are made of a material which is substantially rigid in cross-section to resist compression and decompression forces and which is selected to have good thermal conductivity properties, i.e., thermal conductivity which is at least greater than the thermal conductivity of the conductor insulation. Fiber-filled carbon compositions are suitable for this purpose, and also exhibit good compression resistance. Metals such as steel or aluminum are also suitable for this purpose, as are metal-filled curable polymeric materials. Although less rigid than metal, extruded thermoplastic materials, such as nylon and polypropylene are very suitable for less-severe environmental applications.

While the cable shown in the drawing has three conductors, it will be apparent that the cable could contain a different number and that the number of force-resisting members 20 will usually be one less than the number of conductors.

Inasmuch as the member 20 is quite rigid and resistive to compression in the direction of compressive forces applied in directions substantially perpendicular to the major plane of the cable 10, a greater degree of flexibility may be required which can permit the cable to undergo long-radius bends as necessary when installing it in a service location.

This greater flexibility is typically provided, when defined, by a plurality of longitudinally spaced-apart slots 22 extending inwardly, or downwardly, as illustrated in the figures, from the upper surface 26 of each member 20 and terminating approximately midway or more through the member 20. The slots 22 are substantially uniformly spaced-apart in the longitudinal direction of the member 20. Longitudinally spaced between slots 20 are slots 23 which extend inwardly and upwardly into the body of member 20 from the lower surface 27 thereof. Slots 23 are also substantially uniformly spaced-apart in the longitudinal direction, and lie approximately midway between the slots 22. Thus, the slots 22, 23 extend inwardly in an alternating pattern from the upper and lower surfaces 26 and 27, respectively, and permit greater flexibility in the member 20. When installed in a cable, the resulting structure would be similar in appearance to FIG. 1.

As will be recognized by those skilled in the art, the members 20 can be formed by extrusion, molding or other processes, followed by cutting, if greater flexibility is needed, to form the slots especially if the members are extruded. Each of the members 20 has upper and lower surfaces which are substantially flat so that they conform to the upper and lower, substantially parallel inner and outer side portions 24A and 24B, respectively, of the jacket 11, and the longitudinal edges of the members 20 may be semicircular to conform more closely to the shapes of the opposing peripheral surfaces of insulation on adjacent ones of the insulated conductors. The four corners 28 of the members 20 are slightly rounded as by chamfering, so that the corners 28 do not break off when the cable is bent into a slightly arcuate cross-sectional shape. Crushing forces applied to the exterior of the cable will encounter the members 20 and damage to the cable by such forces will thereby be prevented or at least minimized.

Alternatively, the components interior of the cable jacket can take any of the forms disclosed in my aforementioned patent applications.

To form the desired, slightly arcuate shape, the cable 10 is initially made flat and subsequently drawn through forming dies of appropriate curvature which bend the armor sheathing transversely into a curvature which is substantially the same as that of the structure 30 against which the cable is to be mounted. Because the armor is made of metal, the sheathing remains in the desired curved shape upon removal from the forming dies.

The radius R of the inner arc defining the innermost surface of the side portion 24A of the armor 11 is typically made substantially equal to the radial distance from the centerline to the exterior cylindrical surface portion of the underlaying supporting surface 30. The radius R′ of the outer side portions 24B is typically made equal to the radius R of the inner side portion 24A plus the radial thickness T of the cable. The dimension T is determined by the outer diameter of the insulated conductors plus the total radial thickness of the two side portions 24A and 24B. In order to allow unobstructed placement of the cable in the bore hole while attached to its underlying structure 30, the radius R′ should be less than the radius of the interior wall of the tubular oil well casing. In such case, the dimension T of the cable should be less than the radial dimension of the annular space between the underlying structure and the interior wall of the well casing.

Because the cross-sectional shape of the cable 10 is arcuate, the distance between the outer side portion 24B of the cable 10 and its underlying cylindrical supporting surface remains virtually constant. Were the cable perfectly flat in cross-section, it would be tangential to an underlying cylindrical surface causing the edges thereof to extend further into the available annular space. Hence, the edges would more likely abut or be obstructed by an opposite interior wall of the well casing.

The capability of the instant cable to follow closely its underlying supporting surface is a particularly important feature when the cable is used to feed electrical current to centrifugal pumps driven directly by electrical motors having electrical terminals to which the cable conductors are connected. For this application, the permissable lateral tolerances between the radially spaced-apart casings of the pump and the well are often minimal because, for efficency reasons, it is preferred that the pump diameter be as large as possible. Thus, the cable 10 gives the user the advantage of being able to utilize a larger, more efficient submersible pump.

Moreover, because the pipe to which the cable is to be attached is typically cylindrical, and because the arcuate cable has the same curvature as the pipe, it tends to align itself against the pipe surface with its longitudinal axis parallel to the axis of the pipe. This axial self-alignment feature facilitates the banding of the cable to the underlying pipe as the pipe is inserted in the well bore hole because the cable tends to assume a constant, axial orientation and hence, assumes the same location with respect to the pipe as it pays off its reel.

Figure 2:
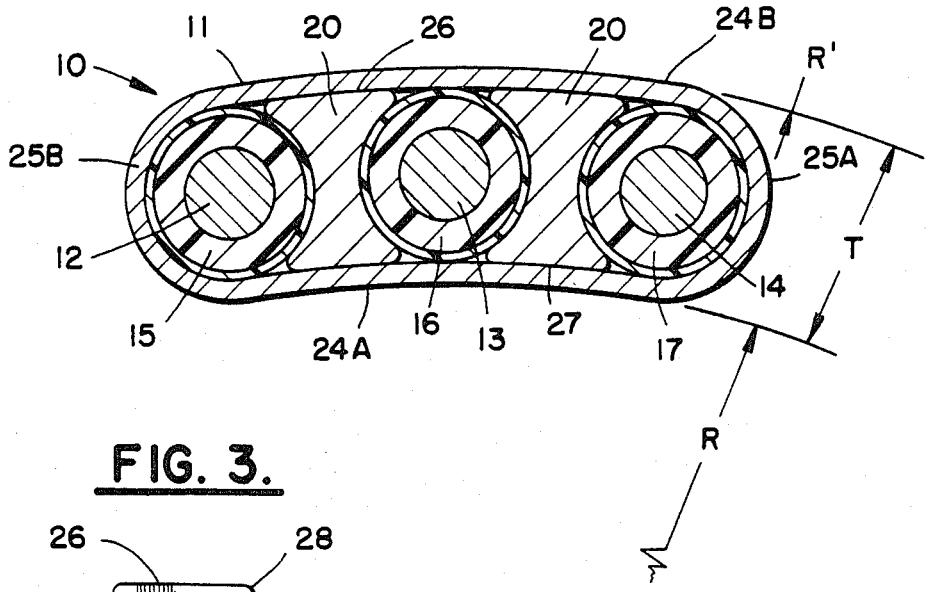
FIG. 2 is an end sectional view of the cable taken along section line 2—2 of FIG. 1 with the underlying structure shown in FIG. 1 removed.
Figure 3:
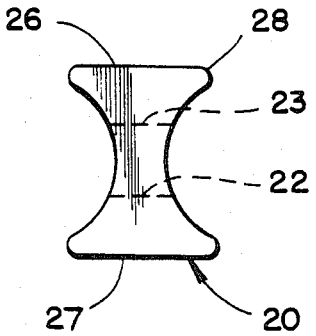
FIG. 3 is an end view of a force-resisting member partially enclosing the insulation on the individual conductors of the cable.

For reasons discussed in detail hereinafter in connection with the embodiments of FIGS. 4 and 5, the upper surface 26 of the member 20 in the arcuately bent cable illustrated by FIG. 2, is preferably slightly wider than the lower surface 27.

Figure 4:
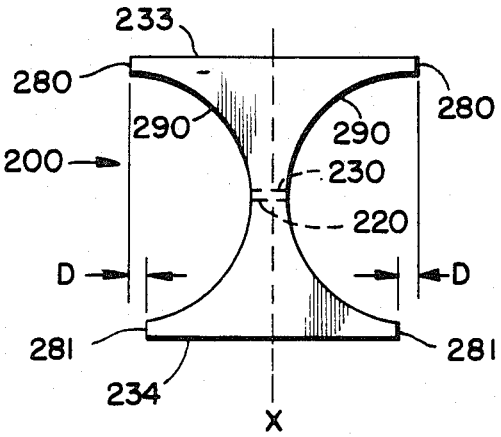
FIG. 4 is an end sectional view of another embodiment of a force-resisting member constructed in accordance with this invention for providing a 180° circumferenced enclosure to the conductor insulation.

With reference to FIG. 4, there is illustrated another embodiment of a force-resisting member 200 which is designed to completely enclose one-half or 180° of the circumference of the insulation on an adjacent one of the conductors when the cable has an arcuate cross-sectional shape. The force-resisting member 200 has initially substantially flat and parallel upper and lower surfaces 233 and 234, respectively, and a vertical axis of symmetry X—X which is perpendicular to these surfaces and passes through the longitudinal axis of the member 200 and which is also substantially perpendicular to the side portions of the cable. The lateral distance from the axis X—X to each upper edge 280 is greater than the corresponding distance between its corresponding lower edge 281 and the X—X axis by an amount D.

Between edges 280 and 281 are a pair of concave surfaces 290 which are semicircular in cross-section with a radius slightly larger than the maximum radius of the outermost layer of conductor insulation to be enclosed by the surface 290. Hence, when the member 200 is positioned against its adjacent conductor, the surface 290 covers one-half of the circumference surface of this insulation layer. The member 200 is slotted at 220 and 230 to increase its flexibility for long-radius bending in directions parallel to the axis X—X.

The substantially I-beam shaped member 200 thus has on the left side first and second laterally extending legs defined, respectively, between surface 233, edge 280 and surface 290 and between surface 234, edge 281 and surface 290, with the central portion of the member between surfaces 290, 290 along the axis of symmetry being a third leg. On the right side, this member has fourth and fifth laterally extending legs so defined by these edges and surfaces.

Figure 5:
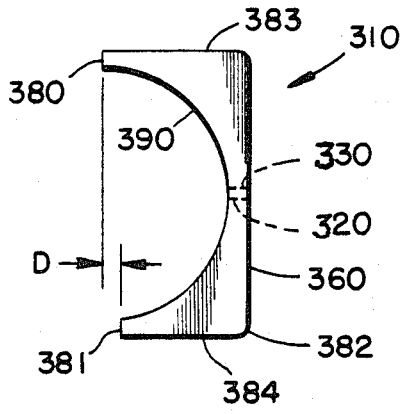
FIG. 5 is an end view of yet another embodiment of a force-resisting member constructed in accordance with this invention, for providing a 180° circumferenced enclosure to the conductor insulation.
Figure 6:
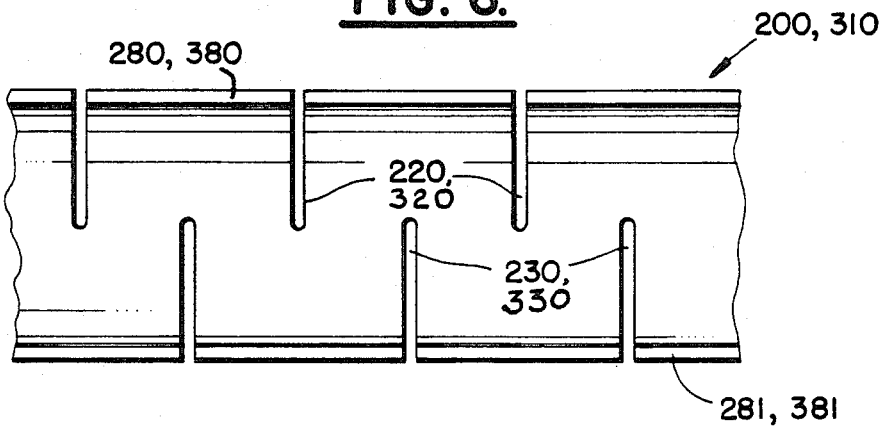
FIG. 6 is a side view of a short length of the members shown in FIGS. 4 and 5.
Figure 7:
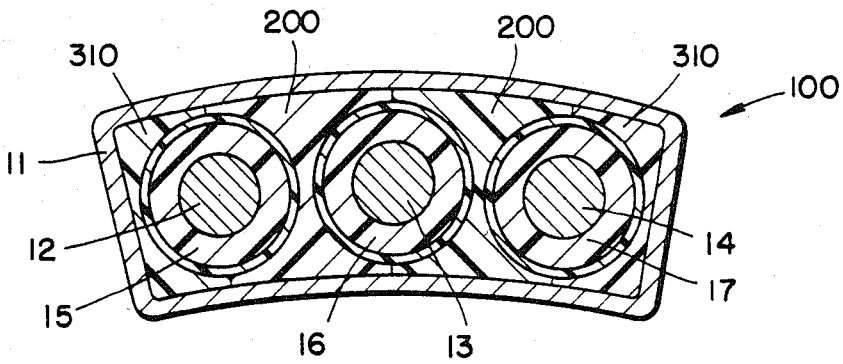
FIG. 7 is an end cross-sectional view of an arcuate cable comprised of pairs of cooperating force-resisting members for providing full enclosure to the insulation on each conductor of the cable.

As seen in FIGS. 5 and 7, each of the outermost halves of the insulation on the two outer conductors 12 and 14 are also protected by a member 310 of substantially "U" cross-sectional shape. Free edges 380 and 381 of the member 310 are initially flat and can abut the edges 280 and 281, respectively, of member 200 such that both outer halves of insulation are entirely enclosed by the two juxtaposed members 200 and 310. This member similarly has first, second and third legs.

The member 310 is essentially a half vertical section of the member 200 with the corners 382 rounded to provide strong edge protection to the cable. The upper and lower surfaces 383 and 384, respectively, are initially flat and the upper surface 383 is also wider than the lower surface 384 by the dimension D. The inner surface 390 between the edges 380 and 381 is also semicircular in cross-section and of the same radius as that of the opposing surface 290 of a member 200. The members 310 are also slotted transversely at 320 and 330 to increase their flexibility for long-radius bending in the vertical plane.

A composite protective structure wrapped with a steel tape 11 for abrasion protection is illustrated by FIG. 7. As therein seen, the entire circumferential surface of the outermost layer of insulation on each conductor 12, 13 and 14 is entirely enclosed by the abutting members 200 and 310.

With the channel members 310 positioned along each outermost conductor 12 and 14 between that conductor and the adjacent cable edge, the substantially flat third leg section 360 of these members define the outer flat edges of the cable protective structure which is sheathed by jacket 11. To minimize the cross-sectional area of the cable, the jacket 11 conforms closely to the substantially rectangular cross-section of the protective structure. During the cable forming operation, the tape forming the jacket 11 is wrapped tightly around the members 310 and the portions of the tape opposite the sides of the cable are forced even closer against the upper and lower surfaces of the force-resisting members 200 and 310 when the arcuate inflection is made to the cable. The desired arcuate cross-sectional shape may be obtained by passing a perfectly flat cable structure longitudinally through coacting metal-forming rollers of appropriate curvature.

As illustrated by FIGS. 2 and 7, the relatively longer transverse circumferential dimension of the outer portion of the jacket 11 resulting from the bending operation causes the outer portion of the jacket 11 to be slightly wider than the inner portion. As best seen in connection with the embodiment of FIG. 4, to provide complete coverage to the outermost layers of insulation, each symmetrical half of a force-resisting member 200 has a transverse cross-section wherein one-half of its upper surface 233 is wider than one-half of its lower surface 234 by the dimension D. As illustrated by FIG. 7, the dimension D is substantially equal to the longer circumferential length of the outer side portion of the jacket directly opposite that half of the surface 233, as compared to the shorter circumferential length of the inner side portion of the jacket directly opposite that corresponding half of the lower surface 234.

Since the members 310 are similar to each vertically symmetrical half section of a member 200, the upper surface 383 of each member 310 is also made wider in cross-section than the lower surface 384 by the dimension D. As illustrated by FIG. 7, after the arcuate bend is made, the edges 280 and 281 of one member 200 will be in abutting relationship with the edges 380 and 381 of a facing member 310 and will form a complete circumferential enclosure to the outermost circumferential surfaces of the two outermost layers of insulation on conductors 12 and 14. Moreover, the edges 280 and 281 of adjacent members 200 will be in abutting relationship and form a complete circumferential enclosure to conductor 13.

The jacket 11 and the members 310 protect the underlying insulation layers from disruptive edge impacts. With the opposing pairs of semicircular surfaces 290 and 390 completely encasing the outermost layer of insulation on each of the conductors 12, 13 and 14, the insulation on each conductor is completely enclosed and protected.

Thus, as seen in FIG. 7, the two members 200 form first and second force-resisting members with their respective first and second legs, which are not arcuate, abutting—the first legs being adjacent the upper side portion of the jacket 11 and the second legs being adjacent the lower side portion. Furthermore, the two members 310 form third and fourth force resisting members with their respective first and second legs, which are now arcuate, abutting the fourth and fifth arcuate legs on the adjacent first and second members 200. Each of the members 200 and 310 are rigid in transverse cross-section to resist transverse compressive forces exerted on the outer jacket 11.

While various advantageous embodiments have been chosen to illustrate the invention, it will be understood by those skilled in the art that various changes and mofifications can be made therein without departing from the scope of the invention as defined in the appended claims.

What is claimed is:

1. An electrical cable comprising:

a plurality of elongated, insulated conductors having a substantially concentric layer of electrical insulation covering each of said conductors, said conductors having substantially parallel longitudinal axes spaced laterally from one another;

a jacket covering said conductors, said jacket being elongated in transverse cross-section and comprised of first and second opposite edge portions and first and second opposite side portions, said side portions of said jacket having an arcuate shape in transverse cross-section, one being laterally wider than the other, and said jacket having sufficient cross-sectional rigidity to maintain the structure arcuate in its transverse cross-section; and at least one elongated, force-resisting member within said jacket positioned between and parallel to the insulated conductors;

said member having first, second and third legs, said third leg extending transversely across the jacket interior substantially from one side portion thereof to the other, said first and second legs extending laterally from said third leg, each being adjacent, respectively, one of said first and second side portions of the jacket and enclosing therebetween at least a portion of the circumferential surface of the insulation;

said third leg having a lesser compressibility in transverse cross-section than said insulation on said one conductor adjacent thereto;

said first leg being adjacent the laterally wider jacket side portion and being laterally wider than said second leg for providing the desired enclosure to the conductor insulation.

2. A cable according to claim 1, wherein said conductors are in side-by-side relationship with the longitudinal axes thereof lying in an arcuate plane, thereby forming a cable having two arcuate substantially parallel opposite sides.

3. A cable according to claim 2, wherein said at least one force-resisting member is a substantially continuous, elongated body having substantially flat upper and lower surfaces adjacent said opposite sides of said jacket.

4. A cable according to claim 3, wherein said member includes a plurality of longitudinally spaced slots extending inwardly alternately from said upper and lower surfaces and terminating close to said arcuate plane containing the longitudinal axes of said conductors.

5. A cable according to claim 1, wherein said force-resisting member is rigid in transverse cross-section to resist transverse compressive forces exerted on said jacket but longitudinally flexible to allow long radius bending along the longitudinal axis thereof.

6. A cable according to claim 1, wherein said force-resisting member is rigid in transverse cross-section to resist transverse compressive forces exerted on said jacket.

7. An electrical cable comprising:

a plurality of elongated, insulated conductors having a substantially concentric layer of electrical insulation covering each of said conductors, said conductors having substantially parallel longitudinal axes spaced laterlly from one another;

a jacket covering said conductors, said jacket being elongated in transverse cross-section and comprised of first and second opposite edge portions and first and second opposite side portions, said side portions of said jacket having an arcuate shape in transverse cross-section; and first and second force-resisting members within said jacket and positioned on opposite sides of one of said conductors, said members each having first, second and third legs, said third legs extending transversely across the jacket interior substantially from the first side portion to the second side portion, said first and second legs extending laterally from the third legs towards the center of the cable, each of the first and second legs being adjacent, respectively, the first side portion and the second side portion of the jacket and enclosing therebetween the surface of the insulation on said one conductor;

said third legs having lesser compressibility in transverse cross-section than said insulation on said one conductor, each of said first legs being laterally wider in cross-section than each of said second legs, and each of said first legs engaging one another and each of said second legs engaging one another to completely enclose said one conductor.

8. A cable according to claim 7, wherein said first and second legs have an arcuate shape in cross-section corresponding respectively to the arcuate shape of said first and second side portions of said jacket.

9. A cable according to claim 7, wherein each of said first and second members further comprises fourth and fifth legs extending laterally from the third legs towards the edge portions of the jacket, each of said fourth and fifth legs being adjacent, respectively, the first side portion and the second side portion of the jacket and enclosing therebetween a portion of the surface of the insulation on another conductor, each of said fourth legs being wider in cross-section than each of said fifth legs in cross-section.

10. A cable according to claim 9, wherein said fourth and fifth legs have an arcuate shape in cross-section corresponding, respectively, to the arcuate shape of said first and second side portions of said jacket.

11. A cable according to claim 9, and further comprising third and fourth force-resisting members, each of said third and fourth members having first, second and third legs, said third legs thereon extending transversely across the jacket interior substantially from the first side portion to the second side portion and being adjacent, respectively, the first and second edge portions of the jacket, said first and second legs thereon extending laterally from the third legs toward the center of the cable, each of the first and second legs thereon being adjacent, respectively, to the first side portion and the second side portion of the jacket and enclosing therebetween a portion of the surface of the insulation on said another conductor.

12. A cable according to claim 11, wherein each of said first legs on said third and fourth members are wider in cross-section than each of said second legs thereon in cross-section.

13. A cable according to claim 11, wherein each of said first legs on said third and fourth members engage respectively said fourth legs on said first and second members, and each of said second legs on said third and fourth members engage respectively said fifth legs on said first and second members, thereby completely enclosing the conductors therebetween.

14. A cable according to claim 11, wherein each of said first, second, fourth and fifth legs are arcuate in cross-section.

* * * * *